United States Patent [19]

Tyler et al.

[11] 4,429,249

[45] Jan. 31, 1984

[54] SEALED BEAM LAMP AND METHOD OF MANUFACTURE

[75] Inventors: David O. Tyler, Anderson; George M. Gasparovic, Pendleton, both of Ind.

[73] Assignee: General Motors Corporation, Detroit, Mich.

[21] Appl. No.: 362,759

[22] Filed: Mar. 29, 1982

Related U.S. Application Data

[63] Continuation of Ser. No. 128,674, Mar. 10, 1980, abandoned.

[51] Int. Cl.[3] ..... H01J 5/16; H01J 61/40; H01K 1/26; H01K 1/30

[52] U.S. Cl. ..... 313/113; 445/4; 445/27

[58] Field of Search ..... 313/113, 114, 115, 315; 445/27, 32, 38

[56] References Cited

U.S. PATENT DOCUMENTS

| | | | |
|---|---|---|---|
| 3,010,045 | 11/1961 | Plagge et al. | 313/113 |
| 3,725,698 | 4/1973 | Craig | 313/113 |
| 3,809,942 | 5/1974 | Boekkooi et al. | 313/113 |
| 4,146,812 | 3/1979 | Gagnon | 313/113 |
| 4,189,657 | 2/1980 | Kimball et al. | 313/113 |
| 4,262,228 | 4/1981 | Cruse | 313/113 X |
| 4,316,240 | 2/1982 | Pitkjaan et al. | 313/113 X |
| 4,363,994 | 12/1982 | Cortorillo et al. | 313/113 |

*Primary Examiner*—David K. Moore
*Assistant Examiner*—Ken Wieder
*Attorney, Agent, or Firm*—E. J. Biskup

[57] ABSTRACT

A lamp having a minimum number of parts consisting of lamp terminals, a lens, light bulb and reflector, the lens and reflector forming a sealed envelope containing the light bulb, the bulb lead wires being secured directly to the inner ends of the terminals positioned within the envelope and constituting a light source assembly. The terminals extend through openings formed at the rear of the reflector, the openings being large enough to allow adjustment of the light source assembly with respect to the reflector in the X-Y-Z axes by manipulating the light source assembly from the rear of and outside the lamp envelope thus simultaneously compensating for variations between bulbs, reflectors and lenses. The lamp is aimed simultaneously with adjustment of said light source assembly. The defined construction eliminates the need for mounting and sealing ferrules and separate lead-in wires between the terminals and the bulb.

5 Claims, 4 Drawing Figures

SEALED BEAM LAMP AND METHOD OF MANUFACTURE

This is a continuation of application Ser. No. 128,674, filed Mar. 10, 1980, abandoned.

The present invention relates to a sealed beam lamp construction which eliminates the need for grinding aiming points by enabling aiming simultaneously with adjustment of the light source filaments with respect to the reflector while minimizing the number of parts used in the manufacture of the lamp and compensating for variations between lamp component parts.

Sealed beam tungsten-halogen lamps are currently available in which the bulb filament support wires are secured to lead-in wires which are in turn brazed or soldered into electrically conducting ferrules sealed on the glass ferrule bosses formed on the rear of the reflector, electrical terminals being soldered on the outer end of each of the ferrules, all as shown in U.S. Pat. No. 4,146,812 issued Mar. 27, 1979 to Gagnon. In assembly of the patented lamp, the bulb is manipulated in the reflector by means of the lead-in support wires extending through the reflector to establish its proper location with respect to the reflector after which the lead-in support wires are soldered to the ferrules and terminals and the excess length of support wire is clipped off. The aim of the lamp is established by means of the conventional lens aiming pads.

The U.S. Pat. to Plagge et al No. 3,010,045 issued Nov. 21, 1961 discloses a sealed beam lamp in which a sealing disc is used to block flow of sealing plastic into the reflector envelope.

In applicants' U.S. Pat. No. 4,310,772 dated Jan. 12, 1982 there is disclosed a sealed beam lamp construction whereby the light source assembly is positioned in a terminal socket which is mounted on a boss formed on the rear of the reflector, adjustment for optimum lighting pattern being achieved by sliding movement between the adjacent mounting surfaces of the terminal socket and the boss, and movement of the light source assembly.

The present invention is designed to enable the simultaneous aim of the lamp and adjustment of the bulb filament in the three axes with respect to the reflector so as to obtain the desired optical pattern, the structure lending itself to high production processing by minimizing the number of parts, by eliminating the need for grinding the aiming pads, and by the manipulation of the light bulb, e.g., a tungsten-halogen bulb, from the rear of and outside the reflector-lens envelope to simultaneously compensate for the variations between reflectors, light sources, and lenses.

Accordingly, it is an object of our invention to provide a sealed beam lamp having a minimum number of parts in which the light bulb may be readily positioned from the rear of the reflector to locate the light source with respect to the reflector and the lens so as to obtain the desired pattern of light therefrom.

It is a further object of our invention to provide a lamp design which enables the use of simple production processing to obtain a sealed beam lamp having a light bulb positioned to locate the filaments with respect to the reflector to obtain the optimum light pattern, the aim of the lamp being achieved wthout the need for grinding the conventional aiming pads while compensating for variations between individual reflector, lens and light source parts. The weight of the lamp is also decreased and thermal stress points are removed by eliminating the conventional elongated corner seating pads.

These and other objects of our invention are obtained by providing a lamp comprising lamp terminals, a lens, light bulb and reflector, the lens and reflector forming a sealed envelope containing the light bulb, the bulb lead or filament support wires being secured directly to the inner ends of the terminals positioned within the envelope and constituting a light source assembly, the terminals extending through openings formed at the rear of the reflector, the openings being large enough to allow adjustment of the light source assembly with respect to the reflector in the X-Y-Z axes. Optimum location of the light source with respect to the reflector is achieved by manipulating the light source assembly from the rear of and outside the lamp envelope thus simultaneously compensating for variations between light sources, reflectors and lenses, the light source assembly being then sealed in the reflector by sealing adhesive, e.g., glass adhesive, epoxy or other resin, which is applied about the terminals in the reflector.

Our invention is more fully described herefollowing and in the drawings in which FIG. 1 is a partially sectioned top view of a sealed beam headlamp made in accordance with our invention;

Figure 1:
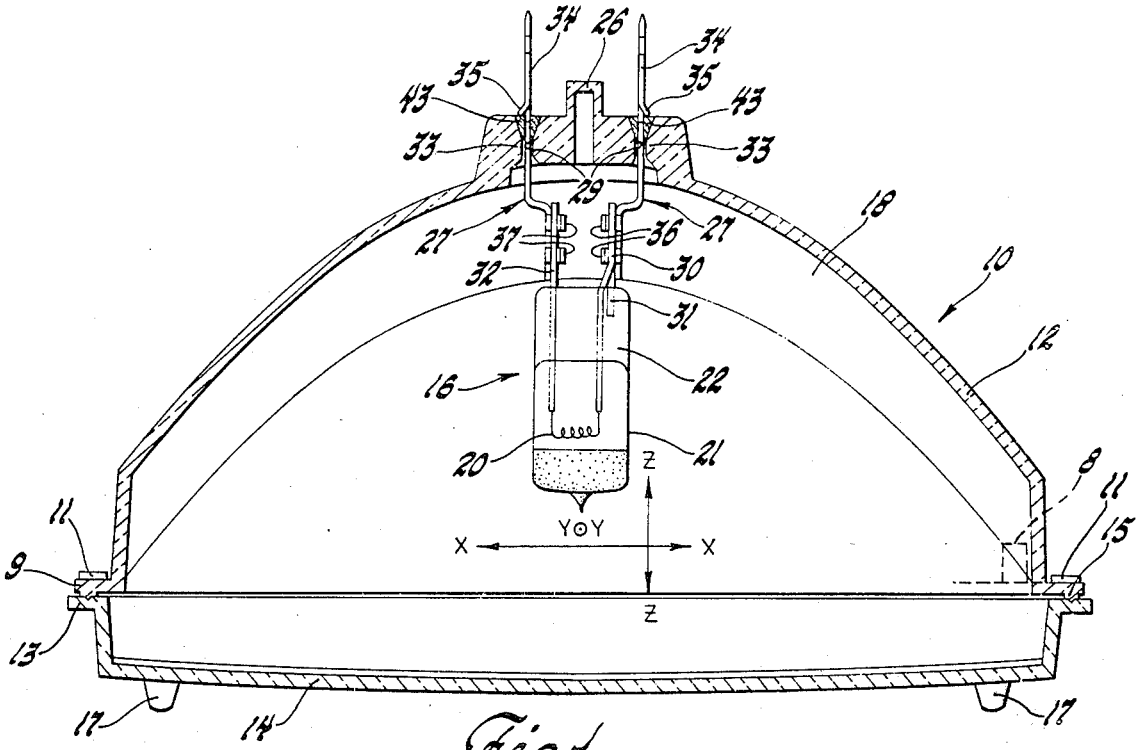

Referring now to FIG. 1, there is shown a rectangular sealed beam lamp 10 of the type commonly used for motor vehicle headlamps. The lamp 10 comprises a reflector 12 and a lens 14 enclosing the light source assembly 16. The reflector 12 and lens 14 may be formed of either glass or plastic as is well known in the lamp forming art. Also, the reflector 12 has a parabolic reflective surface 18 with a bright metallic deposit for directional control of the light rays emitted by the filament 20. Reflector 12 is provided with corner seating pads 11 on the rear surface of the reflector sealing flange 9. As shown, these pads are of limited height and mass, and, since they are not formed on the body portion of the reflector, points of thermal stress inherent in the usual design are eliminated. Also, instead of forming one of the pads 11 with a substantially larger area than the remaining pads for lamp orienting purposes, we prefer to use at least one orienting tang 8 formed off-center on the rear surface of the reflector. The lens 14 includes suitable optical flutes and facets for imparting directional control to light rays projected by the reflector 12. Aiming pads 17 are provided on the front surface and are of significantly shorter height than the pads normally used. The pads 17 are formed as short as possible while being long enough to enable the establishment of an aiming plane since there is no need for grinding off their ends. The aim of the lamp is achieved at the same time the light assembly 16 is oriented with respect to the reflector 12, the lamp envelope being oriented to obtain the desired aim by use of known equipment gaged to the lens aiming pads 17. This allows the height of the aiming pads to be reduced thus significantly reducing the number of rejects due to breaking during grinding and handling.

The lens 14 and the reflector 12 are joined at their peripheral flanges to form a leak-proof seal. As shown, a ridge or lip 15 is formed on the peripheral flange 9 of the reflector, alternatively on the lens flange 13, and a seal is obtained by any suitable means such as ultrasonic welding, flame sealing or use of adhesive, e.g., an epoxy or polyester based adhesive, or glass adhesive. Structurally, any suitable mating design may be used, e.g., the lip-flange design shown or a lip-channel design such as that shown in U.S. Pat. No. 3,625,796.

The light source assembly 16 is structurally joined to the reflector 12 by means of terminals 27 sealed on the rear of the reflector as shown in the drawings. The inner surfaces of the assembled components define a sealed lamp envelope having a controlled environment of inert or dry gas.

The light source assembly 16 consists of filament 20, shown in FIG. 1 as contained in a bulb 21, e.g., a tungsten-halogen bulb, a pair of terminals 27, and a pair of lead wires 30, 32 connected to the ends of filament 20 and extending through the pinch portion 22 of bulb 21 for electrical connection with their respective terminals 27.

As shown in FIG. 1, the terminals 27 are formed with an outer end blade portion 34 adapted for interconnection with a suitable power source, the inner end being provided with a plurality of tabs 36 and 37 to which lead wires 30 and 32 are respectively crimped for electrical and mechanical interconnection. Other suitable means such as spot welding and the use of a separate support wire 31, support straps, tabs or projections in the bulb pinch portion may be used. While a single filament bulb is shown, it should be understood that a two filament bulb well known in the art may also be used, the third wire being electrically connected to a third terminal sealed within the reflector in the same manner as described herein.

As shown in the drawings, the central portion of reflector 12 is formed to provide a plurality of openings 29 through which the outer ends 34 of terminals 27 extend. Tabs 35 may be formed on the terminals to prevent them from falling through the openings once they are passed therethrough. As shown in FIG. 1, the rear of the reflector through which the terminals 27 are passed is thickened and the openings 29 are provided in concavities or recesses formed in both the inner and outer reflector surfaces with their bottom surfaces closely spaced apart to form a relatively thin section 33 in the reflector 12 about the terminals to enable the rocking movement of the terminals during assembly. The reflector 12 is also provided with evacuating means, shown as a sealed-off evacuating tube 26. As shown, the light source assembly 16 is supported in reflector 12 by the sealing adhesive 43, the correct positioning of bulb 21 and its filament 20 for obtaining the desired light pattern and aim being obtained in the manner described herein.

The width of the section 33 closely surrounding the terminals 27 is maintained sufficiently thin to enable rocking movement of the terminals for ready adjustment of the filament 20 with respect to the reflector 12 in the up-down (Y—Y) and sideways (X—X) directions, adjustment in the longitudinal or front-rear (Z—Z) direction being achieved by the front-rear movement of the terminals 27 through the openings 29. While the adjustment of the light source assembly may be accomplished before or after sealing the lens 14 on the face of reflector 12 during assembly in a machine of the type known in the art, we prefer to accomplish adjustment after sealing the lens on the reflector. Upon achieving the desired lighting pattern, the adhesive is activated, e.g., by ultraviolet light, heat, or other suitable means, and the position of the light source assembly 16 is fixed with respect to reflector 12.

In the assembly of the lamp shown in FIG. 1 in accordance with our invention, the terminals 27 are fixtured to maintain the specified positioning for each terminal, this being accomplished using mechanisms well known in the art and forming no part of our invention. The bulb 21 is then electrically connected to and mechanically supported on terminals 27 by securing the lead wires 30 and 32 of the bulb to tabs 36 and 37 to form light source assembly 16. Assembly 16 is positioned in reflector 12 with blade portions 34 extending through the openings 29, this combination being then loaded into an assembly fixture also no part of our invention. The lens 14 is then positioned on the reflector 12 and a sealing bond is effected between the two in any suitable manner, e.g., flame sealing or by using the adhesive 43 as previously described. The sealing adhesive 43 is then dispensed in predetermined amount into the recesses about openings 29 on the surface of reflector 12 and about terminal portions 34. As noted above, any suitable adhesive may be used, but we prefer to use an ultraviolet light activated polyester based adhesive such as Loctite 352 (modified)$^{(R)}$ or LO-727$^{(R)}$ available from Loctite Corporation, Newington, Conn. Also, while the sequence is described as dispensing adhesive prior to adjustment of the bulb position, this may be performed after such adjustment and reference to the one is intended to include the other. Bulb 21 is lit and the light source assembly 16 is moved by the assembly fixture in the X-Y-Z directions. The proper adjustment is determined by optical sensors when the predetermined optical optimum position producing the desired lighting pattern is achieved. The lamp is also aimed at the same time in accordance with applicable lighting standards. The adjusted assembly is then subjected to the activating or setting ultraviolet light to effect the adhesive cure. Since all component parts affecting the optical pattern are in place at the time of adjustment, this operation compensates for all variations between the optical components with resultant cost and quality benefits and is preferred. As described above, any suitable sealing technique may be used. The sealed envelope formed by the lens 14 and reflector 12 is then exhausted and/or flushed through the fill opening, tube 26, a replacement fill of inert and/or dry gas being provided, after which the tube is sealed.

Figure 2:
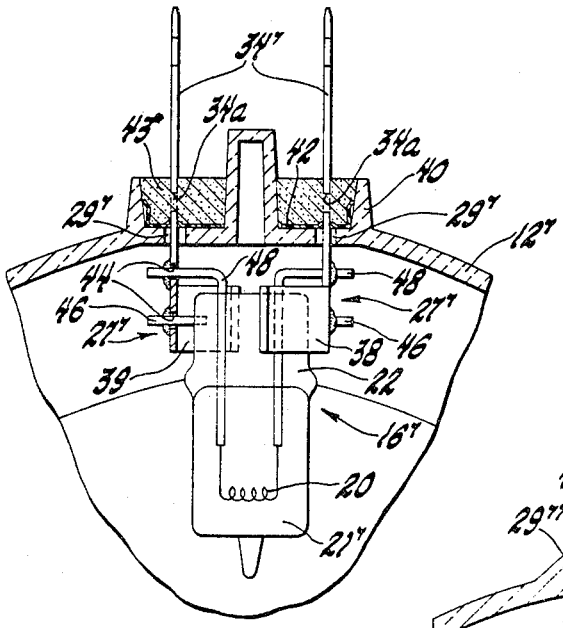
FIG. 2 is a broken-away view similar to FIG. 1 showing modifications of the light source assembly and the reflector construction.
Figure 3:
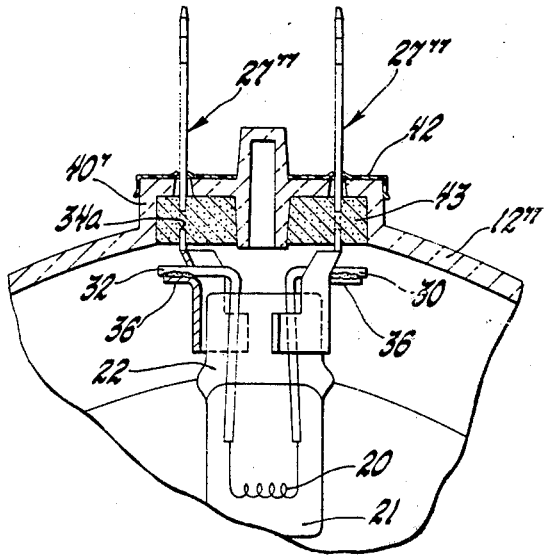
FIG. 3 is a view similar to FIG. 2 showing further modifications of the reflector and light source assembly construction.
Figure 4:
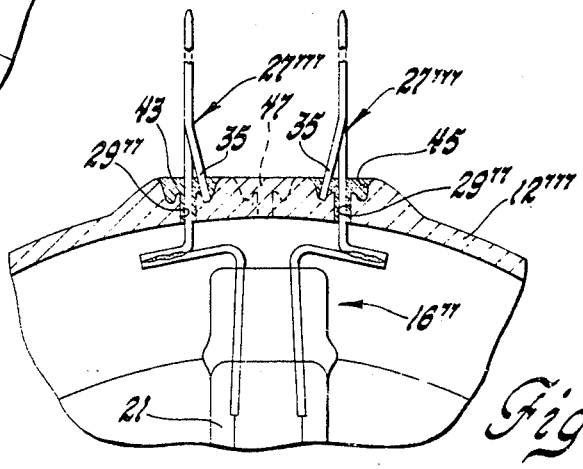
FIG. 4 is a view similar to FIG. 2 showing the preferred embodiment of the reflector and light source assembly construction.

While we have described our invention in terms of the embodiment shown in FIG. 1, modifications of this design are shown in FIGS. 2, 3, and 4.

In FIG. 2 the reflector 12' is formed with a cup-shaped portion or recess 40 at the rear thereof and on its outer surface. The openings 29' through which the blade portions 34' of terminals 27' extend are within the cup-shaped or recess portion 40 and are large enough to permit adjustment of the light source assembly 16' in the up-down and sideways directions for obtaining the aim of the lamp and the optimum optical positioning with respect to reflector 12'. The adhesive 43, as previously described, is used to fix the position of assembly 16' in the adjusted position. Holes **34*a* are shown in terminal blade portions 34' to improve the anchoring of the terminals in the cement. A retainer shield 42 is positioned in recess portion 40 to fit closely about terminal blade portions 34' to prevent flow of the adhesive 43 into the reflector. Shield 42 may alternatively be positioned on the inner surface of reflector 12'** or may be omitted if appropriate.

Also in FIG. 2, the terminals 27' are shown as having their inner ends formed by bending to provide clips 38 and 39, the latter shown broken away, similar to those disclosed in the aforementioned U.S. Pat,. No. 4,310,772 for supporting the pinch portion of bulb 21'. The inner end of each terminal 27' is provided with spaced holes 44 in which support wires 46 and lead wires 48 are positioned and securely attached, e.g., spot welded, soldered, brazed and/or clamped to form good support and electrical interconnections. The same method of assembly is used as previously described for the embodiment of FIG. 1 and all other features of the lamp are as previously described.

FIG. 3 shows a further embodiment of our invention, similar to that of FIG. 2, wherein the cup-shaped or recess portion 40' is formed on the inner surface of reflector 12''. Also, the shield 42 is shown on the outer surface of reflector 12'' but may be alternatively located on the inner surface in portion 40'. The bulb 21 is electrically interconnected with and supported by the terminals 27'' by means of tabs 36 to which the lead wires 30 and 32 are spot welded or brazed in the same manner as shown in U.S. Pat. No. 4,310,772. The method of assembly is the same as previously described and all other features of the lamp are as previously described.

FIG. 4 shows the preferred embodiment of our invention wherein the rear of the reflector 12''' through which the terminals 27''' are passed is thickened and the openings 29'' are provided in an annular recess 45, or in separate recesses formed about each opening, the openings conforming to the shape of the terminals passing therethrough and being large enough to permit adjustment of the light source assembly 16'' in the X, Y, and Z directions as described. The adhesive 43 is positioned in the recess 45 about terminals 27''' to achieve a seal in openings 29''. The bulb 21 is electrically interconnected with and supported by the inner end of terminals 27''' which may be crimped and/or welded about the end of lead wires 30 and 32. This terminal - lead-in wire configuration is preferred as being most economical and reliable. Evacuation or flushing and refill of the lamp envelope is achieved through fill opening 47, in the rear of the reflector, this being plugged by a sealing adhesive such as that described herein. The method of assembly is the same as previously described and all other lamp features are as previously described.

From the foregoing, it is apparent that we have provided a lamp structure having a minimum number of parts as well as a method of assembly eliminating all need for preorientation of the lamp filaments with respect to one or more indexing surfaces on one or more parts of the lamp structure. Instead, the structure of our invention permits the simple and simultaneous aim and adjustment of the light source assembly in all three directions during the assembly operation and after the sealing of the lens on the reflector to thus compensate for any variations between the parts making up the lamp assembly. Changes in the design and method will be apparent to those skilled in the art such as substitution of materials, variations in reflector-lens peripheral flange mating design, bulb construction, bulb to terminal assembly, terminal variations and various terminal-reflector design combinations, and the like, all within the scope of our invention as defined by the claims which follow.

The embodiments of the invention in which an exclusive property or privilege is claimed are defined as follows:

1. A sealed beam lamp consisting of at least two lamp terminals each of which has a blade portion provided with an inner end and an outer end, a lens, light bulb and reflector, said lens being positioned on and sealed to the front of a flange formed on the open front end of said reflector to form a sealed envelope containing the light source, said light bulb being supported by and having lead wires which are electrically connected to said inner ends of said blade portions of said terminals and positioned within said envelope and constituting a light source assembly, said terminals extending through terminal openings formed at the rear of said reflector so as to locate said outer ends exteriorly of said envelope for interconnection with a power source, means formed on at least one of said terminals for preventing said light source assembly from falling into said envelope, said terminal openings being large enough to allow adjustment of said light source assembly with respect to said reflector in the X-Y-Z axes to obtain optimum location of said light source assembly with respect to said reflector, said light source assembly being secured in said reflector by adhesive made of an insulating material contained in a recessed portion surrounding each of said terminals, said sealed beam lamp further including aiming pads on said lens face to enable the establishment of an aiming plane, and means provided on the outer surface of said reflector to enable seating of said sealed beam lamp in a vehicle in an oriented position, the aim of said sealed beam lamp being achieved at the same time said light source assembly is positioned with respect to said reflector.

2. A sealed beam lamp as set forth in claim 1 wherein said recess on said reflector is a cup-shaped portion surrounding said terminals.

3. A sealed beam lamp as set forth in claim 1 wherein said means on the outer surface of said reflector consists of seating pads positioned on the rear surface of said flange with either one of said pads being specially formed to serve as an orienting member.

4. The method of manufacturing a sealed beam lamp consisting of a light bulb, a reflector having a fill opening and a plurality of terminal openings in the rear thereof, a lens, and lamp terminals, said light bulb having lead wires, and each of said terminals comprising a blade portion provided with an inner end and an outer end; said method comprising the steps of:

(a) fixturing said outer end of each of said lamp terminals to obtain the desired positioning therebetween;

(b) interconnecting said light bulb lead wires with said inner ends of said terminals to establish good mechanical support and electrical contact therebetween to form a light source assembly;

(c) placing said light source assembly in said reflector;

(d) extending said terminals through said terminal openings so as to locate said outer end of each blade portion exteriorly of said reflector and maintaining said terminals within said terminal openings by having an offset part of at least one of said blade portions engage an exterior portion of said reflector;

(e) dispensing a predetermined amount of adhesive made of an insulating material onto said reflector and into a recessed portion surrounding said terminals;

(f) lighting said light bulb and moving said light source assembly in the up-down, sideways, and forward-backward directions to position said light bulb relative to said reflector so as to obtain a predetermined optical optimum position producing the desired lighting pattern while simultaneously establishing the aim of said sealed beam lamp;

(g) activating said adhesive to fix said light source assembly in the established relative position;

(h) forming a sealed envelope between said lens and said reflector by positioning and sealing said lens on the front end of said reflector;

(i) removing the moisture from said envelope and filling said envelope with a dry gas through said fill opening; and (j) sealing said fill opening formed in said reflector.

5. The method of manufacturing a sealed beam lamp consisting of a light bulb, a reflector having a plurality of terminal openings in the rear thereof, a lens, and lamp terminals, said light bulb having lead wires, and each of said terminals comprising a blade portion provided with an inner end and an outer end; said method comprising the steps of:

(a) fixturing said outer end of each of said lamp terminals to obtain the desired positioning therebetween;

(b) interconnecting said light bulb lead wires with said inner ends of said terminals to establish good mechanical support and electrical contact therebetween to form a light source assembly;

(c) placing said light source assembly in said reflector and extending said terminals through said terminal openings so as to locate said outer end of each blade portion exteriorly of said reflector;

(d) maintaining said terminals within said terminal openings by having an offset part of at least one of said blade portions engage an exterior portion of said reflector;

(e) sealing said lens on the front of said reflector to form an envelope and a leak-proof seal between said lens and said reflector;

(f) evacuating said envelope and filling said envelope with a dry gas;

(g) lighting said light bulb and moving said light source assembly in the up-down, sideways and forward-backward directions to position said light bulb relative to said reflector so as to obtain a predetermined optical optimum position producing the desired lighting pattern while simultaneously establishing the aim of said sealed beam lamp;

(h) dispensing a predetermined amount of adhesive made of an insulating material onto said reflector and into a recessed portion surrounding said terminals; and (i) activating said adhesive to fix said light source assembly in the established relative position.

* * * * *